US005845627A

United States Patent [19]

Olin et al.

[11] Patent Number: 5,845,627

[45] Date of Patent: Dec. 8, 1998

[54] INTERNAL COMBUSTION ENGINE PNEUMATIC STATE ESTIMATOR

[75] Inventors: Peter M. Olin, Ann Arbor; Peter J. Maloney, Dearborn, both of Mich.

[73] Assignees: General Motors Corporation, Detroit, Mich.; Delco Electronics Corporation, Kokomo, Ind.

[21] Appl. No.: 866,202

[22] Filed: May 30, 1997

[51] Int. Cl.[6] ..... F02D 41/18

[52] U.S. Cl. ..... 123/676; 123/677; 701/108; 73/118.2

[58] Field of Search ..... 123/676, 677; 701/102, 103, 104, 105, 107, 108; 73/117.3, 118.2

[56] References Cited

U.S. PATENT DOCUMENTS

| | | | |
|---|---|---|---|
| 4,984,456 | 1/1991 | Takahashi | 773/118.2 |
| 5,003,950 | 4/1991 | Kato et al. | 73/118.2 |
| 5,465,617 | 11/1995 | Dudek et al. | 73/118.2 |
| 5,682,867 | 11/1997 | Katoh et al. | 123/676 |
| 5,704,340 | 1/1998 | Togai | 123/676 |
| 5,714,683 | 2/1998 | Maloney et al. | 72/118.2 |

OTHER PUBLICATIONS

SAE Paper, 92023, Nonlinear, Closed Loop, SI Engine Control Observers, Hendricks et al, Dated Feb. 24–28.

U.S. application No. 08/759276, Maloney, filed Dec. 2, 1996.

U.S. application No. 08/759277, Maloney, filed Dec. 2, 1996.

U.S. application No. 08/862074, Maloney, filed May 22, 1997.

*Primary Examiner*—Erick R. Solis
*Attorney, Agent, or Firm*—Michael J. Bridges

[57] ABSTRACT

Pneumatic state estimation operations for estimating gas flow and pressure at pneumatic nodes and flow branches within a reticulated engine system for engine control and diagnostic operations resolves net flow imbalances at specific pneumatic nodes and attributes such imbalances to inaccuracies in pneumatic state estimation. Inaccuracies are corrected as a function of a prior pneumatic state estimate and of a net flow imbalance at the node or a neighboring node for precision engine control and diagnostic operations.

11 Claims, 3 Drawing Sheets

INTERNAL COMBUSTION ENGINE PNEUMATIC STATE ESTIMATOR

TECHNICAL FIELD

This invention relates to internal combustion engine pneumatic state estimation and, more particularly, to pneumatic state estimation and correction for engine system control and diagnostics.

BACKGROUND OF THE INVENTION

It has been proposed to reticulate an internal combustion engine system into an interdependent network of nodes and flow paths for estimating the rate at which gasses flow through the engine system for application in engine system control and diagnostic procedures as disclosed in the copending U.S. patent application Ser. No. 08/759,276 hereby incorporated herein by reference and assigned to the assignee of this application. Generally, the estimation applies certain assumptions or approximations to a sequential analysis of pneumatic pressure and flow rate through the network, moving from one flow path to the next, until detailed dynamic information characterizing pressure and gas flow through the engine system is developed for application in engine control or diagnostic operations.

It has been determined that such assumptions may not be valid throughout a period of operation of an engine system, leading to reduced estimation accuracy. The estimation is repeated during an engine system operating cycle to maintain current pressure and flow rate information throughout the network and may include several throughput intensive operations, such as numerical integration operations. As such, certain compromises may be required so that the estimation may be implemented in a controller having throughput limitations and having various other control, maintenance and diagnostic responsibilities. For example, a relatively granular estimation iteration rate may be required so as to not overwhelm controller throughput. Estimation stability may be compromised under certain operating conditions with such an iteration rate, leading to reduced estimation accuracy under such operating conditions.

Any reduction in estimation accuracy, for example due to invalid assumptions relating to physical system characteristics, sensor input characteristics, and engine system environment, or to reduced estimation iteration rate, may result in an inconsistency in the flow estimation of the network. For example, reduced estimation accuracy may lead to an imbalance in net flow at a node of the network in which net flow into the node deviates in an unexpected manner from net flow out of the node. Such an inconsistency can lead to reduced engine system control and diagnostic accuracy.

It would therefore be desirable to determine when a significant estimation inaccuracy is present in engine system flow analysis, and to correct the inaccuracy to preserve engine control and diagnostic precision.

SUMMARY OF THE INVENTION

The present invention is directed to estimating pneumatic states within an engine system reticulated into a flow network for engine control and diagnostic procedures wherein pneumatic state estimation information is applied to resolve inconsistencies within the network to improve overall estimation accuracy and increase engine system control and diagnostic precision.

More specifically, a sequence of interdependent gas flow rate estimation operations are periodically carried out during an engine system operating cycle for various flow paths within an engine system. Under certain operating conditions, the resulting flow rate estimations are applied to a conservation of flow model to identify deviations in net flow away from an expected net flow of at least one node of the reticulated network. Weaknesses in the estimation approach are identified and attributed to any identified deviation. The gas flow error corresponding to such weaknesses in the estimation approach are gradually corrected as a function of the identified deviation to minimize any flow error, to preserve engine control and diagnostic precision.

In accord with a further aspect of this invention, a node of the eticulated engine system, such as in the engine intake or exhaust manifold, is identified and all pneumatic states that significantly directly or indirectly affect gas flow through the identified node are estimated through application of a pneumatic state estimation approach. Under certain operating conditions, such as steady state operating conditions characterized by substantially no gas filling or depletion at the node, at which point dynamic estimation is no longer required, net gas flow at the identified node is calculated by combining all estimated pneumatic states for the node. If the net gas flow deviates from an expected net flow, such as zero net flow under steady state operating conditions, an estimation error is assumed to be present. A correction is made to an identified weakness in the estimation approach as a function of the determined net gas flow deviation.

In accord with still a further aspect of this invention, the identified node is within the engine intake manifold and the corresponding model weakness is, under certain operating conditions, a prior estimate of atmospheric (barometric) pressure. The gas flow deviation in the intake manifold node is applied to correct the prior atmospheric pressure estimate. Cost and inconvenience associated with expensive barometric pressure sensing hardware and calibration procedures, including burdensome procedures to calibrate the effects of change in barometric pressure at various altitudes, are thereby avoided. In accord with still a further aspect of this invention, the identified node is within the engine exhaust manifold. Pneumatic state estimation instability under certain operating conditions at such node leads to state estimation error which is gradually reduced toward zero as a function of an identified deviation in net flow in the exhaust manifold. The resulting gains in stability allow for application of numerically intensive estimation procedures in practical controller-based systems having significant throughput constraints.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
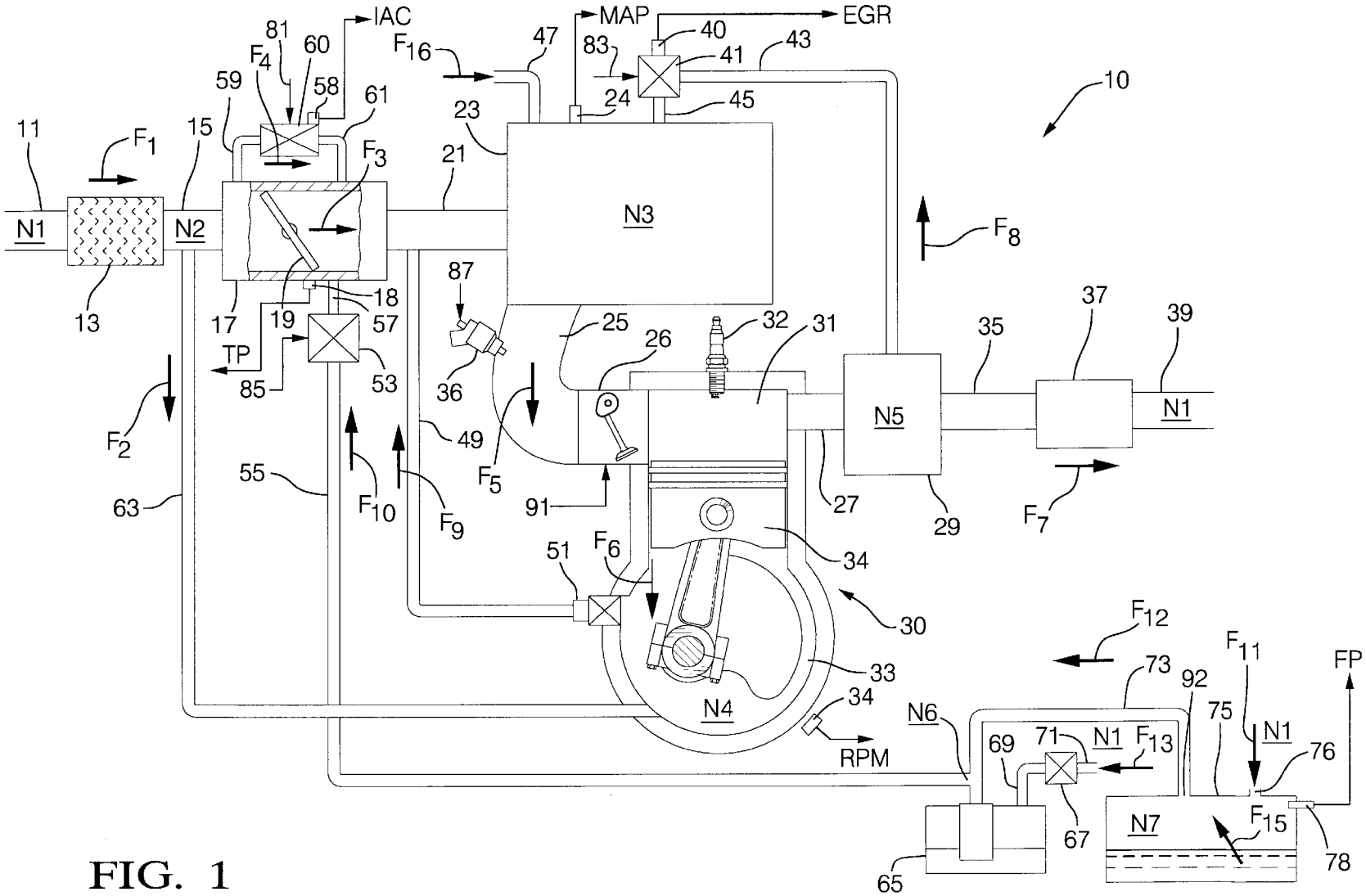
FIG. 1 is a general diagram of an internal combustion engine system including a network of gas flow paths through various pneumatic elements in accordance with the preferred embodiment of this invention.

Referring to FIG. 1, a conventional internal combustion engine system is illustrated to which control and diagnostic operations are applied in accordance with this embodiment. The engine system is reticulated into an interdependent network of gas mass flows designated by arrows labeled as $F_1$–$F_{16}$ between a network of pneumatic volume nodes designated as N1–N7. Inlet air at atmospheric pressure at node N1 passes through fresh air inlet 11 through air cleaner 13 and into intake duct 15 at node N2. The inlet air is drawn across through throttle body 17 in which is rotatably disposed an inlet air valve 19 in the form of a throttle plate the position of which is manually or electronically controlled to vary restriction to inlet air passing through the throttle body and into intake duct 21 for passage into intake manifold 23 at node N3. In this embodiment, a conventional pressure transducer 24 is exposed to gas pressure in the intake manifold 23 and transduces such pressure into output signal MAP.

Individual cylinder intake runners, one runner 25 being illustrated in FIG. 1, open into the intake manifold 23 and into the combustion chamber of respective engine cylinders, one combustion chamber 31 of one respective cylinder 30 being shown in FIG. 1. Each cylinder, such as cylinder 30, includes a combustion chamber, such as combustion chamber 31 and a crankcase, such as crankcase 33, separated by a piston, such as piston 34 which substantially sealingly engages the wall of the cylinder 30. A quantity of fuel is injected, via conventional fuel injector 87, in response to a fuel injection command signal applied thereto, into the intake runner 25 for mixing with the inlet air, wherein the resulting mixture is drawn into the combustion chamber 31 during a cylinder intake event during which an intake valve 26 is driven to an open position and during which a low pressure condition is present in the combustion chamber 31. The air-fuel mixture is ignited in the combustion chamber 31 during a combustion event initiated by a timed ignition arc driven across the spaced electrodes of spark plug 32 which extends into the combustion chamber 31. The piston 34 within the cylinder 30 is reciprocally driven under the effective pressure of the combustion event for driving vehicle wheels, accessory loads, etc., as is generally understood in the art. Gasses produced in the combustion process within the combustion chamber 31 are exhausted from the combustion chamber 31 during a cylinder exhaust event and through exhaust runner 27 to exhaust manifold 29 at node N5. The exhaust gasses pass through the exhaust manifold 29 to exhaust duct 35 leading to catalytic treatment device and muffler (generally illustrated as element 37) and then to the atmosphere at the pressure of node N1.

Vacuum is selectively applied to the cylinder crankcase 33 at node N4 through a positive crankcase ventilation (PCV) conduit 49 including a standard PCV valve 51, the PCV conduit being connected between the crankcase 33 and the intake duct 21, the vacuum for drawing blow-by gasses that have been driven from the cylinder combustion chamber 31 to the crankcase 33 under the pressure of the combustion process. A supply of fresh inlet air from node N2 is provided to the crankcase 33 via a fresh air conduit 63 connected between the intake duct 15 and the crankcase 33. The PCV valve selectively draws the blow-by gasses from the crankcase for mixing with intake air for consumption in engine cylinders for purifing engine system lubricants.

A portion of the exhaust gasses are drawn from the exhaust manifold 29 at node N5 through an exhaust gas recirculation (EGR) conduit 43 and across an EGR valve 41 of the electrical solenoid type responsive to an EGR control signal on line 83 and further through a conduit 45 into the intake manifold 23 at node N3 for mixing with inlet air for delivery to the engine cylinder combustion chambers. The state of the EGR valve is controlled electronically as is generally understood in the art in response to general operating conditions to vary the dilution of the fresh inlet air with substantially inert exhaust gas to provide for a reduction in the engine emissions component of oxides of nitrogen (NOx).

A portion of inlet air is routed through conduits 59 and 61 having a conventional idle air bypass valve 60 therebetween of the solenoid type responsive to an idle air command signal on line 81, for bypassing the restriction of the inlet air valve 19 within the throttle body 17 under certain generally-known control conditions such as idle operating conditions in which precise control of relatively low fresh air flow rates is required. Brake boost conduit 47 of any conventional type opens into intake manifold 23 at node N3 providing for a minor gas flow $F_{16}$ during application of a conventional service brake pedal of an automotive vehicle (not shown) as is well-known in the art.

Vehicles equipped with well-known evaporative emission controls may also have gas flow through a canister purge valve 53 and canister purge conduits 55 and 57 into throttle body 17 downstream, according to the normal direction of flow through the throttle body 17, of the inlet air valve 19 with the actual effective flow into intake manifold at node N3. Charcoal canister 65 generally releases fuel vapors when fresh air is drawn through purge vent 67 and purge vent conduits 69 and 71. Fuel tank 75 may also release fuel vapors which may be absorbed in canister 65, may be released thereby, or may pass directly to the engine along with released fuel vapors through conduit 55 at node N6 for consumption in the described cylinder combustion process. Fuel tank 75 having a supply of fuel therein at node N7 may include a leak orifice 76 through which fresh air may enter the fuel tank. Conventional pressure transducer 78 is disposed within the fuel tank 75 for transducing vapor pressure within the tank into an out output signal FP. Fuel vapor passes from the fuel tank 75 through a conventional rollover orifice 92 and to the canister 65 via tank vapor recovery conduit 73.

Disposed between the above-described nodes are flow paths including flow path $F_1$ across the air cleaner 13 between nodes N1 and N2, flow path $F_2$ along PCV fresh air conduit 63 between nodes N2 and N4, flow path $F_3$ through throttle body 17 across the inlet air valve 19 from node N2 to intake duct 21, flow path $F_4$ through idle air bypass conduits 59 and 61, flow path $F_5$ through the intake runner 25 between node N3 and the cylinder combustion chamber 31, flow path $F_6$ between the combustion chamber and the crankcase (node N4) of an engine cylinder 30, flow path $F_7$ to the atmosphere at node N1 through catalytic treatment device and muffler elements 37 and exhaust ducts 35 and 39, flow path $F_8$ through EGR conduits 43 and 45 between node N5 and the EGR valve 41, flow path $F_9$ through the PCV conduit 49 between node N4 and the intake duct 21 (effectively at node N3), flow path $F_{10}$ through the conduit 55 between node N6 and the throttle body 17 (effectively at node N3), flow path $F_{11}$ through leak orifice 76 into fuel tank 75 between nodes N1 and N7, flow path $F_{12}$ from fuel tank 75 across rollover orifice 92 and through conduit 73 between nodes N7 and N6, flow path $F_{13}$ across purge vent 67 into purge canister 65 between nodes N1 and N6, fuel vaporization flow path $F_{15}$ within fuel tank 75, and flow path $F_{16}$ through the brake boost conduit 47 between the braking system (not shown) and the node N3.

Figure 2:
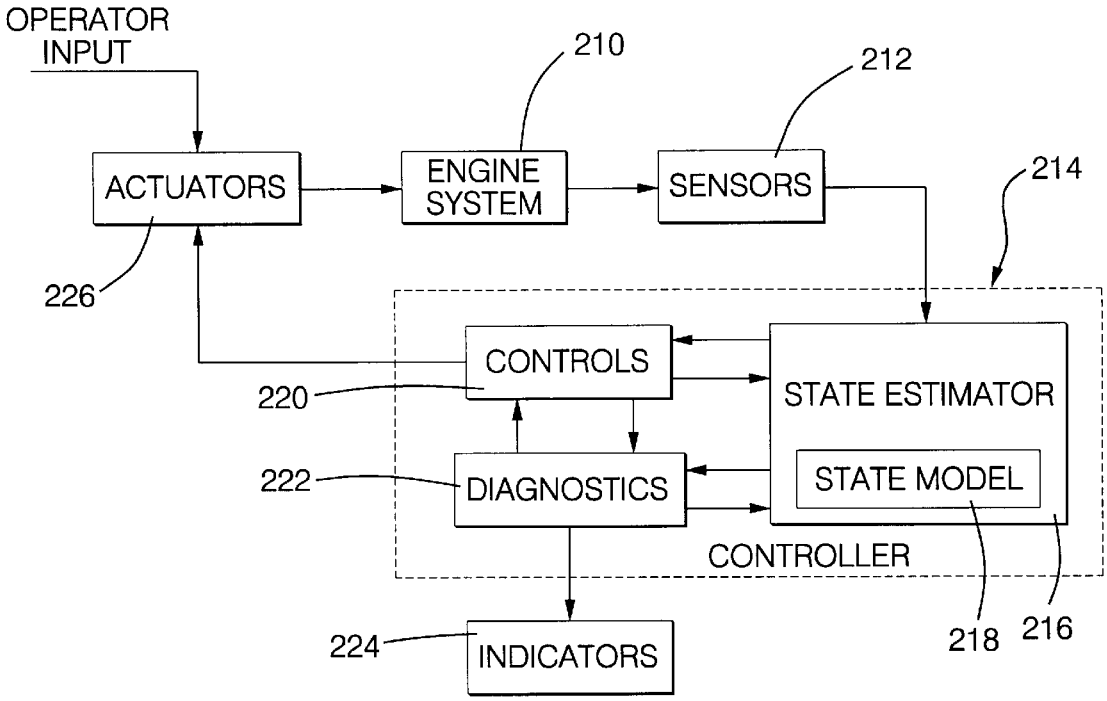
FIG. 2 is a general signal flow diagram illustrating an engine system control and diagnostic network for estimating pneumatic states and for controlling and diagnosing the engine system in accord with the preferred embodiment of this invention.

Referring to FIG. 2, a general diagram illustrating engine system control and diagnostics includes an engine system 210, such as the engine system of FIG. 1 having various parameters transduced by various conventional sensors 212 into signals applied to a controller 214 which carries out a sequence of state estimation operations for estimating pressures of interest at certain of the nodes of FIG. 1, such as at nodes N3, N5, N6, and N7 in this embodiment and for determining mass flow rates at certain of the flow branches of FIG. 1, such as flow branches $F_3$, $F_4$, $F_5$, $F_7$, $F_8$, $F_{10}$, $F_{11}$, $F_{12}$, $F_{13}$ and $F_{15}$ in this embodiment. A state model 218 for modeling such pressures and flows is included with the state estimator 216. Pressure and flow outputs are provided from the state estimator 216 to various controls 220, for example for controlling engine fueling, inlet air rate, EGR rate, and to various diagnostic procedures 222 for diagnosing certain engine control systems using the pressure and flow information. The controls 220 issue control signals to drive various engine system control actuators 226, such as fuel injectors 87 (FIG. 1), air control valves 19 and 60 (FIG. 1), EGR valve 41, etc. in accordance with generally available control strategies. Manual operator inputs may further be applied to such actuators, as is generally understood in the art. The diagnostics 222 interact with the controls according to standard control and diagnostic procedures and may provide diagnostic information to various conventional indicators 224, such as lamps or chimes. The controller 214 takes the form of a conventional single-chip microcontroller in this embodiment including such conventional elements as a central processing unit, an input-output unit, and memory devices including random access memory RAM devices, read only memory ROM devices and other standard elements.

Figure 3:
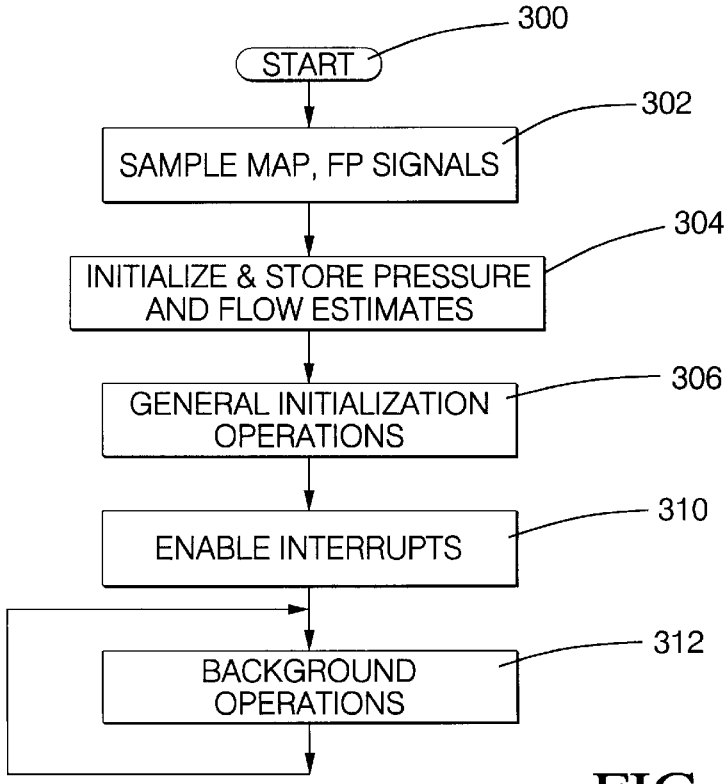
FIGS. 3 and 4 are computer flow diagrams illustrating a flow of operations of the controller of FIG. 2 for carrying out pneumatic state estimation and correction, and control and diagnostic operations of the engine system of FIG. 1.
Figure 4:
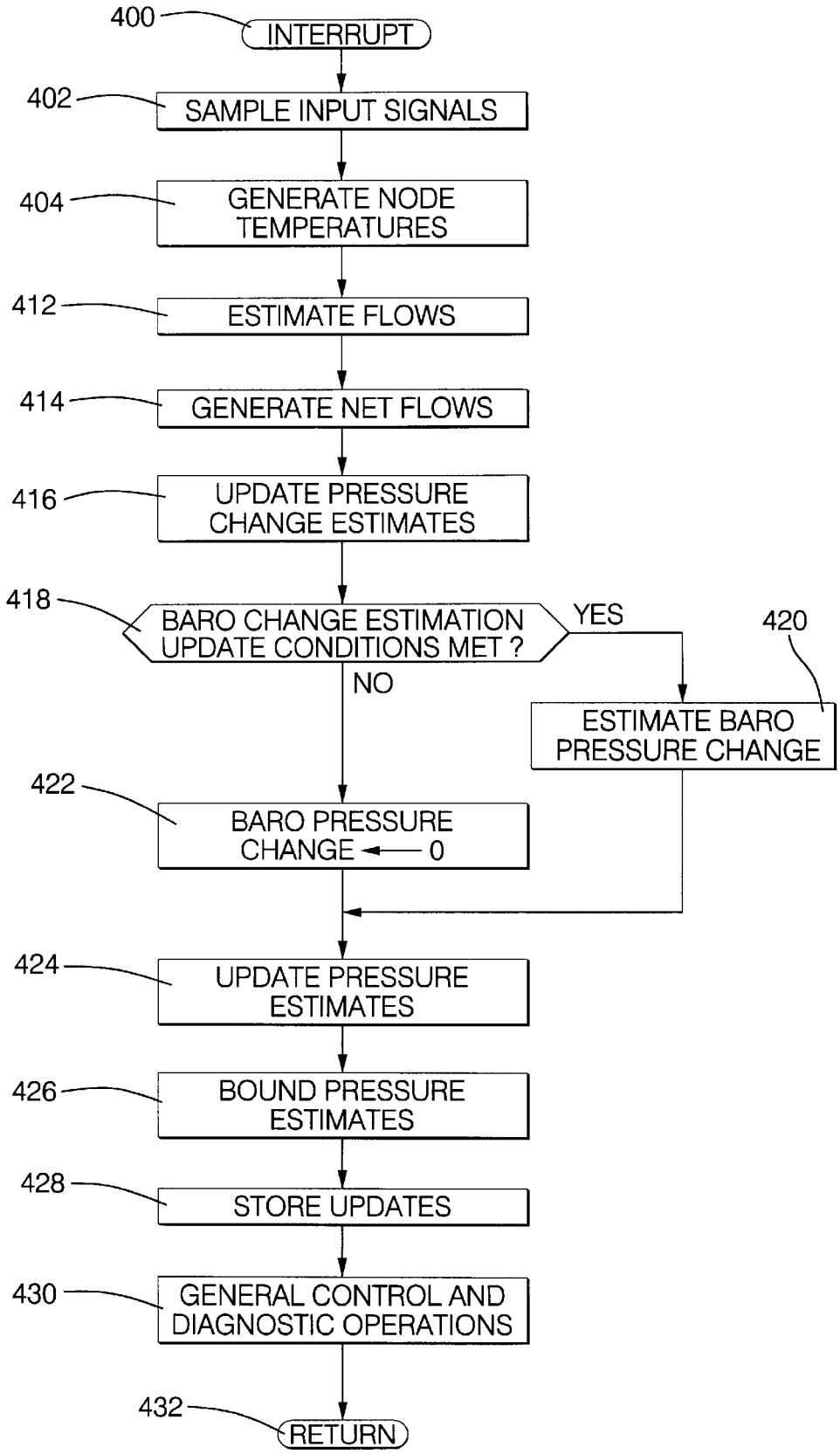

Referring to FIGS. 3 and 4, flow diagrams for illustrating a flow of start-up operations and control and diagnostic operations for carrying out the estimation and correction operations of this embodiment detail, in a step by step manner, processes carried out by the controller 214 of FIG. 2 and implemented in the form of a set of instructions stored in a ROM device of the controller. The operations provide for estimation of pressure at nodes N3, N5, N6 and N7 of FIG. 1 through estimation of mass flow into and out of such nodes, and for estimation and correction of certain pressures, including barometric pressure at node N1 when contradictory flow information at a node is identified. The flow and pressure information is then applied in general engine system control and diagnostic operations.

More specifically, upon application of ignition power to the controller of FIG. 2 at the start of an engine system ignition cycle, such as when an engine system operator rotates an ignition cylinder to an "on" position, the operations of FIG. 3 are initiated beginning at a step 300 and proceed to a next step 302 at which signal MAP from the transducer 24 of FIG. 1 is sampled as an indication of the present gas pressure in the intake manifold 23 of FIG. 1 and signal FP from transducer 78 of FIG. 1 is sampled as an indication of the present fuel tank 75 (FIG. 1) vapor pressure. Pressure and flow estimate information is next initialized at a step 304 as follows:

$$P_{at}(t)=P_{im}(t)=P_{em}(t)=P_{ec}(t)=MAP;$$

$$P_{ft}(t)=FP; \text{ and}$$

$$f_{thr}(t)=f_{iac}(t)=f_{egr}(t)=f_{eng}(t)=f_{exh}(t)=f_{prg}(t)=f_{rol}(t)=f_{lv}(t)=f_{vnt}(t)=0,$$

in which $P_{at}(t)$ is estimated atmospheric (barometric) pressure at time t, $P_{im}(t)$ is estimated intake manifold pressure at node N3 (FIG. 1) at time t, $P_{em}(t)$ is estimated exhaust manifold pressure at node N5 at time t, $P_{ec}(t)$ is estimated evaporative canister 65 (FIG. 1) pressure at node N6 at time t, $P_{ft}(t)$ is estimated fuel tank pressure at node N7 (FIG. 1) at time t, $f_{thr}(t)$ is gas flow rate across the air valve 19 of FIG. 1 (flow branch $F_3$) at time t, $f_{iac}(t)$ is gas flow rate across the bypass valve 60 of FIG. 1 (flow branch $F_4$) at time t, $f_{egr}(t)$ is gas flow rate through the EGR conduit 43 of FIG. 1 (flow branch $F_8$) at time t, $f_{eng}(t)$ is gas flow through the engine cylinder intake runner 25 of FIG. 1 (flow branch $F_5$) at time t, $f_{exh}(t)$ is gas flow through exhaust duct 35 of FIG. 1 (flow branch $F_7$) at time t, $f_{prg}(t)$ is gas flow across the purge valve 53 of FIG. 1 (flow branch $F_{10}$) at time t, $f_{rol}(t)$ is gas flow across the rollover orifice 92 of FIG. 1 (flow branch $F_{12}$) at time t, $f_{lv}(t)$ is gas vaporization and leak flow within the fuel tank 75 of FIG. 1 (flow branches $F_{11}$ and $F_{15}$) at time t, $f_{vnt}(t)$ is gas flow through the purge vent valve 67 of FIG. 1 (flow branch $F_{13}$) at time t, and wherein t is currently set to zero (at engine system startup).

Returning to FIG. 3, following specific pressure and flow initialization operations at the step 304, any required general initialization operations are next carried out at a step 308 including such well-known startup operations as operations to clear memory locations, to transfer data and program instructions from ROM devices to RAM devices, and to set pointers, counters and constants to initial values. It should be pointed out that the operations of step 308 may be required to be carried out prior to the step 304. Numerous time and event based interrupts are next enabled at a step 310 to occur following certain time intervals, or following certain engine system events such as cylinder top dead center events whereby interrupt service operations are carried out following such interrupts to provide for synchronous and asynchronous engine system control, diagnostic and maintenance operations. Background operations are then carried out at a next step 312 including general, low priority maintenance and diagnostic operations, including operations to diagnose the engine system through application of the pneumatic state estimation information provided by the state estimator 216 of FIG. 2.

Referring to FIG. 4, a series of operations for servicing an interrupt which, in this embodiment is a standard timer-based interrupt but which may alternatively be an event-based interrupt, for example following engine cylinder top dead center events, are detailed in a step by step manner for execution following occurrence of an interrupt enabled at the described step 310 of FIG. 3. In this embodiment, such timer-based interrupt is set up to occur approximately every five to ten milliseconds while the controller 214 of FIG. 2 is manually activated by an engine system operator. The series of operations begin, following each such interrupt occurrence, after temporarily suspending any ongoing controller operations of lower priority in a pre-established priority hierarchy, at a step 400 and proceed to sample input signals at a next step 402, including signals MAP, TP, RPM, and FP of FIG. 1. Temperature estimation operations are next carried out at a step 404, including operations for directly measuring or estimating gas temperature at various nodes within the engine system of FIG. 1, including at nodes N1, N3, N5, N6, and N7 of FIG. 1. For example, the temperature estimation operations described in the disclosure of copending U.S. patent application Ser. No. 08/862,074, attorney docket number H-197436, filed May 22, 1997, assigned to the assignee of this application and hereby incorporated herein by reference may be carried out at the step 404 at such nodes.

Returning to FIG. 4, gas flow estimates of interest are next determined at a step 412 as follows:

$$f_{thr}(t) = f_{thr}^{std}\left(\frac{P_{im}(t)}{P_{at}(t)}, TP\right) \cdot Cp(P_{at}(t)) \cdot Ct(T_{at}(t)),$$

$$f_{iac}(t) = f_{iac}^{std}\left(\frac{P_{im}(t)}{P_{at}(t)}, IAC\right) \cdot Cp(P_{at}(t)) \cdot Ct(T_{at}(t)),$$

$$f_{egr}(t) = f_{egr}^{std}\left(\frac{P_{im}(t)}{P_{em}(t)}, EGR\right) \cdot Cp(P_{em}(t)) \cdot Ct(T_{em}(t)),$$

$$f_{eng}(t) = f_{eng}^{std}\left(\frac{P_{em}(t)}{P_{im}(t)}, RPM\right) \cdot Cp(P_{im}(t)) \cdot Ct(T_{im}(t)),$$

$$f_{exh}(t) = f_{exh}^{std}\left(\frac{P_{at}(t)}{P_{em}(t)}\right) \cdot Cp(P_{em}(t)) \cdot Ct(T_{em}(t)),$$

$$f_{prg}(t) = f_{prg}^{std}\left(\frac{P_{im}(t)}{P_{ec}(t)}\right) \cdot Cp(P_{ec}(t)) \cdot Ct(T_{ec}(t)),$$

$$f_{rol}(t) = f_{rol}^{std}\left(\frac{P_{ec}(t)}{P_{ft}(t)}\right) \cdot Cp(P_{ft}(t)) \cdot Ct(T_{ft}(t)),$$

$$f_{vnt}(t) = f_{vnt}^{std}\left(\frac{P_{ec}(t)}{P_{at}(t)}\right) \cdot Cp(P_{at}(t)) \cdot Ct(T_{at}(t)),$$

and $$f_{lv}(t) = f_{lv}(t-1) + h \cdot f_{lv},$$

wherein the term $f_{lv}(-1)$ is initialized to zero, such as at the prior step 304, and the gas mass flow rate at flow path $F_{11}$ and $F_{15}$ (FIG. 1), termed $\dot{f}_{lv}(t)$, is determined as follows:

$$\dot{f}_{lv}(t) = K_{lv}[FP(t) - P_{ft}(t)],$$

with FP(t) being the transduced fuel vapor pressure within the fuel tank 75 (FIG. 1) at time t, and in which $$f_{thr}^{std}\left(\frac{P_{im}(t)}{P_{at}(t)}, TP\right)$$

is a calibrated three-dimensional lookup table having entries representing standard gas flow through the inlet air valve 19 (FIG. 1), $$f_{iac}^{std}\left(\frac{P_{im}(t)}{P_{at}(t)}, IAC\right)$$

is a calibrated three-dimensional lookup table having entries representing standard gas flow through the bypass valve 60 (FIG. 1), $$f_{egr}^{std}\left(\frac{P_{im}(t)}{P_{em}(t)}, EGR\right)$$

is a calibrated three-dimensional lookup table having entries representing standard gas flow through the EGR valve 41 (FIG. 1), $$f_{eng}^{std}\left(\frac{P_{em}(t)}{P_{im}(t)}, RPM\right),$$

is a calibrated three-dimensional lookup table having entries representing standard gas flow through the intake runner 25 (FIG. 1), $$f_{exh}^{std}\left(\frac{P_{at}(t)}{P_{em}(t)}\right)$$

is a calibrated three-dimensional lookup table having entries representing standard gas flow through the engine exhaust manifold 29 (FIG. 1), $$f_{prg}^{std}\left(\frac{P_{im}(t)}{P_{ec}(t)}\right)$$

is a calibrated three-dimensional lookup table having entries representing standard gas flow through the purge solenoid valve 53 (FIG. 1), $$f_{rol}^{std}\left(\frac{P_{ec}(t)}{P_{ft}(t)}\right)$$

is a calibrated two-dimensional lookup table having entries representing standard gas flow through the rollover orifice 92 (FIG. 1), $$f_{vnt}^{std}\left(\frac{P_{ec}(t)}{P_{at}(t)}\right)$$

is a calibrated two-dimensional lookup table having entries representing standard gas flow through the canister purge vent valve 67 (FIG. 1), h is the iteration rate of the step 412, which is about one iteration every five to ten milliseconds in this embodiment, $K_{lv}$ is a calibrated gain, and in which density correction values Cp(.), and Ct(.) are standard two-dimensional lookup tables having entries of correction values stored, like the above standard flow tables, in ROM devices of the controller 214 of FIG. 2, for example in the form of standard lookup tables, wherein such entries are determined through standard calibration procedures, applying standard physics principles known to those possessing ordinary skill in the art to correct gas density for the actual upstream pressure and temperature conditions, the Cp(.) entries stored in such tables and referenced therefrom as a function of upstream gas pressure in a Cp lookup table, and the Ct(.) entries stored in such tables and referenced therefrom as a function of upstream gas temperature as measured or estimated at the described step 404. The argument of each Cp(.) and Ct(.) element in the flow equations of the above step 412 indicate the estimated pressure or temperature used as an index into the corresponding table to return the corresponding correction value.

Returning to FIG. 4, the flow estimates determined at the step 412 are next applied to determine the net flow of each node of interest within the engine system of FIG. 1. The net gas flow through the intake manifold 23 (FIG. 1)

$$f_{im}^{net}(t)$$

is determined as $$f_{im}^{net}(t)$$

$$= f_{thr}(t) + f_{iac}(t) + f_{egr}(t) + f_{pgr}(t) - f_{eng}(t).$$

The net gas flow through the exhaust manifold $$f_{em}^{net}(t)$$

is determined as $$f_{em}^{net}(t)$$

$$=f_{eng}(t)-f_{exh}(t)-f_{egr}(t).$$

The net gas flow through the evaporative canister $$f_{ec}^{net}(t)$$

is determined as $$f_{ec}^{net}(t)$$

$$=f_{rol}(t)-f_{prg}(t)+f_{vnt}(t).$$

The net gas flow through the fuel tank 75 (FIG. 1), $$f_{\mathrm{ft}}^{\mathrm{net}}(t)$$

is determined as $$f_{\mathrm{ft}}^{\mathrm{net}}(t)$$

$$=f_{lv}-f_{rol}.$$

The net flow and pressure estimate information is next applied at a step 416 to update pressure change estimates at the intake manifold 23, exhaust manifold 29, evaporative canister 65, and fuel tank 75, all of FIG. 1, through the following respective equations:

$$\dot{P}_{\mathrm{im}}(t) = \left\{ \begin{array}{ll} C_{im} f_{im}^{net}(t) + L_{im} \cdot [MAP(t) - P_{im}^{m}(t)] & \text{if } P_{im}(t) < B_{im}^{ub} \cdot P_{at}(t) \\ 0 & \text{if } P_{im}(t) > B_{im}^{ub} \cdot P_{at}(t) \end{array} \right\},$$

$$\dot{P}_{\mathrm{em}}(t) = C_{em} f_{em}^{net}(t) + L_{em}\,[MAP(t) - P_{im}(t)],$$

$$\dot{P}_{\mathrm{ec}}(t) = K_{ec} \cdot f_{ec}^{net},$$

and $$\dot{P}_{\mathrm{ft}}(t) = K_{ft} \cdot f_{ft}^{net} + L_{ft}\,[FP - P_{ft}(t)],$$

in which $C_{im}$ is an intake manifold pneumatic capacitance, determined as $$C_{im} = \frac{RT_{im}(t)}{V_{im}},$$

in which R is the generally-known universal gas constant, $T_{im}(t)$ is estimated or measured intake manifold gas temperature at time t, and $V_{im}$ is measured intake manifold volume, $C_{em}$ is an exhaust manifold pneumatic capacitance, determined as $$C_{em} = \frac{RT_{em}(t)}{V_{em}}$$

in which $T_{em}(t)$ is estimated or measured exhaust manifold gas temperature at time t, $V_{em}$ is measured exhaust manifold volume, $L_{im}$ is an intake manifold state estimator gain, which is a system-specific value established through a conventional calibration procedure, $L_{em}$ is an exhaust manifold state estimator gain, which is a system-specific value established through a conventional calibration procedure, $$B_{im}^{ub}$$

is a multiplicitive constant defining a system-specific upper bound on the intake manifold pressure estimate, and $K_{ec}$, $K_{ft}$, and $L_{ft}$ are system-specific calibrated gains.

The change in the barometric pressure estimate is next determined in accord with an important aspect of this invention via steps 418–420 through application of the net gas flow through the intake manifold 23 (FIG. 1) to identify any flow imbalance in the intake manifold, with any such flow imbalance attributed to a change in barometric pressure away from a prior barometric pressure estimate, whereby accurate barometric pressure estimation may be provided without the expense of a dedicated barometric pressure sensor and without burdensome calibration procedures at varying altitudes, as described. The estimate of change in barometric pressure requires steady state flow conditions through the intake manifold 23 (FIG. 1) characterized by substantially no manifold filling or depletion, operation in regions in which gas flow through the intake manifold is substantially insensitive to throttle body 17 (FIG. 1) part to part variation, and operation in regions in which gas flow rate through the throttle body 17 is substantially insensitive to small pressure variations in the intake manifold 23. Such conditions, are summarized in this embodiment are analyzed at a step 418 and must all be met for a barometric pressure change update to be carried out. More specifically, at step 418, if:

$$|\dot{P}im(t+h)|<50\ kPa/s,$$

$$TP(t)<10\%, \text{ and}$$

$$P_{im}(t) \leqq UB(P_{at}),$$

in which UB ($P_{at}$) is an upper pressure bound determined as a function of a most recent prior atmospheric pressure estimate, then barometric pressure change is updated via step 420 as follows:

$$\dot{P}_{\mathrm{at}}(t+h) = K_{at} \cdot f_{im}^{net}(t),$$

in which $K_{at}$ is determined as approximately $-1\times10^{3}$ $$\frac{Pa/s}{kg/s}.$$

Alternatively, if the entry conditions of step 418 are determined to not be met, barometric pressure change is set to zero at a next step 422. Following the determination of barometric pressure change, the pressure change estimates are integrated at a next step 424, such as through the Euler Numerical Integration Algorithm, hich is generally known in the art to which this invention pertains, to yield pressure estimates at various nodes of interest of the engine system of FIG. 1, as follows:

$$P_{at}(t+h)=P_{at}(t)+h\cdot\dot{P}_{at}(t)$$

$$P_{im}(t+h)=P_{im}(t)+h\cdot P_{im}(t)$$

$$P_{em}(t+h)=P_{em}(t)+h\cdot\dot{P}_{em}(t)$$

$$P_{ec}(t+h)=P_{ec}(t)+h\cdot\dot{P}_{ec}(t)$$

$$P_{ft}(t+h)=P_{ft}(t)+h\cdot\dot{P}_{ft}(t)$$

in which h is the update rate of step 424, which is about one update every five to ten milliseconds in this embodiment, as described. The estimates of step 424 are subject to certain instabilities, for example due to the relatively granular iteration rate h, which is selected as the highest iteration rate that can be tolerated within the throughput constraints and competing priorities of the controller that carries out the operations of FIG. 4, such as controller 214 of FIG. 2, so as to provide as much estimation stability as possible. To further assure estimation stability, for example under operating conditions determined to suffer certain estimation instabilities due, for example, to the relatively granular iteration rate h, the estimates are next bounded at a step 426 as follows:

$$P_{at}(t+h)=max(P_{at}(t+h), MAP),$$

in which the pseudo-function max(), returns the element of the greatest magnitude, which is itself bounded between hard limits, such as between 85 kPa and 105 kPa. $P_{im}$(t+h) may be bounded on an upper magnitude bound by a pressure maximum of MAP or of a calibrated percentage of atmospheric pressure, and may be bounded on a lower magnitude bound by a pressure minimum of ten kPa. $P_{em}$(t+h) may be bounded, if determined to be in an unstable region substantially close to atmospheric pressure, by restricting the change in estimated exhaust manifold pressure from one update to the next to a predetermined percentage of the net gas flow through the exhaust manifold as determined at the described step 414, and may in any case be limited to no lower a pressure than atmospheric pressure. $P_{ec}$(t+h) and $P_{fi}$(t+h) are bounded between pre-set pressure limit values, which may be established as system-specific calibrated values.

After bounding the pressure estimates at the step 426, the updated temperature, pressure and flow information determined through the steps of FIG. 4 is stored in a standard memory device of the controller 214 (FIG. 2), such as a conventional RAM device, as the most recent temperature, pressure and flow information for use in engine system control and diagnostic operations, and for use in the next iteration of the operations of FIG. 4 during which such stored values are updated in the manner described for steps 402–426. Conventional engine control and diagnostic operations are next carried out at step 430. Such operations include, for example, operations to determine and provide for issuance of a fuel injector drive command on line 87 of FIG. 1 as a function of the estimated gas flow rate along flow branch F5 of FIG. 1, an idle air command on line 81 of FIG. 1 as a function of manual operator input and estimated gas flow into the intake manifold via flow path F4, canister purge valve position command on line 85 of FIG. 1 as a function of estimated gas flow rate along flow branch F10, EGR valve position drive command on line 83 of FIG. 1 as a function of gas flow along flow branch F8, etc. Conventional diagnostic operations, such as operations to diagnose operability of valves 19, 60, 41, 67, and orifice 92 may further be carried out at the step 430 using the temperature, pressure and flow information determined through the operations of FIG. 4.

Following such control and diagnostic operations, the operations of FIG. 4 are concluded by returning, via a next step 432, to any prior operations that may have been temporarily suspended to provide for servicing of the interrupt that triggered execution of the operations of FIG. 4. The operations of FIG. 4 are repeated, following certain events, such as engine cylinder events, or following certain time periods, to update temperature, flow, and pressure estimates in the above-described manner and to provide for control and diagnostic in response to such estimates. The inventors intend that other operations for correcting pressure or flow estimates or changes in pressure or flow estimates may be provided by extending the estimation operations of FIG. 4 to further pneumatic states within an engine system within the scope of this invention. Indeed, the preferred embodiment is not intended to limit or restrict the invention since many modifications may be made through the exercise of ordinary skill in the art without departing from the scope of the invention.

The embodiments of the invention in which a property or privilege is claimed are described as follows.

We claim:

1. A method for estimating pneumatic states including a gas pressure state within an internal combustion engine system having a plurality of gas flow branches, comprising the steps of:

defining a pneumatic node within an engine system through which gasses flow along at least two gas flow branches;

estimating gas flow along the at least two gas flow branches;

combining the estimated gas flows to form a net flow of gasses at the defined pneumatic node; and estimating gas pressure at a predetermined pneumatic node within the engine system as a predetermined function of the net flow of gasses.

2. The method of claim 1, wherein the estimating step further comprises the steps of:

generating a pressure change value as a predetermined function of the net flow of gases; and estimating gas pressure at the predetermined pneumatic node as a function of the pressure change value and of a prior pressure estimate.

3. The method of claim 1, further comprising the steps of:

generating an engine control command as a function of the estimated gas pressure; and controlling engine operation in accordance with the engine control command.

4. The method of claim 1, wherein the engine system includes an intake manifold, wherein the defined pneumatic node is within the intake manifold, the predetermined pneumatic node is external to the engine system at atmospheric pressure, and wherein the step of estimating gas pressure comprises the steps of:

providing a base atmospheric pressure estimate;

calculating a change in atmospheric pressure as a predetermined function of the net flow of gasses in the intake manifold; and estimating atmospheric pressure as a predetermined function of the calculated change in atmospheric pressure and of the base atmospheric pressure estimate.

5. The method of claim 1, wherein the engine system includes an exhaust manifold, wherein the defined and predetermined pneumatic nodes are within the exhaust manifold, and wherein the step of estimating gas pressure comprises the steps of:

identifying a presence of operating conditions characterized by significant exhaust manifold pressure estimation instability;

estimating change in gas pressure in the exhaust manifold as a function of the net flow of gasses when the operating conditions are identified as present; and estimating gas pressure at the predetermined pneumatic node as a function of the estimated change in gas pressure.

6. A method for estimating gas pressure in an internal combustion engine system represented as a network of pneumatic nodes having gas flow paths therebetween, comprising the steps of:

estimating gas pressure at at least two of the pneumatic nodes;

selecting a pneumatic node of the engine system through which gasses flow along at least two corresponding gas flow paths;

estimating gas flow through the corresponding gas flow paths;

calculating net gas flow at the selected pneumatic node as a function of the estimated gas flow through the corresponding gas flow paths;

generating an estimated pressure at a predetermined pneumatic node as a function of the calculated net gas flow.

7. The method of claim 6, further comprising the step of:

controlling engine operation in response to the corrected estimated pressure.

8. The method of claim 6, wherein the engine system includes an intake manifold pneumatic node and an external pneumatic node at atmospheric pressure, and wherein the step of estimating gas pressure estimates gas pressure at the intake manifold pneumatic node and the external pneumatic node, wherein the selected pneumatic node is the intake manifold pneumatic node, and wherein the correcting step corrects the estimated pressure at the external pneumatic node as a function of the calculated net gas flow.

9. The method of claim 6, wherein the engine system includes an exhaust manifold and the network of pneumatic nodes includes an exhaust manifold pneumatic node, wherein the step of estimating gas pressure further estimates gas pressure at the exhaust manifold pneumatic node, wherein the selected pneumatic node is the exhaust manifold pneumatic node, and wherein the correcting step corrects the estimated pressure at the exhaust manifold pneumatic node as a function of the calculated net gas flow.

10. The method of claim 6, further comprising the steps of:

determining a current engine system operating condition;

providing, for the current engine system operating condition, an expected net gas flow at the selected pneumatic node;

wherein the step of estimating gas flow estimates gas flow through the corresponding gas flow paths at the current engine system operating condition; and determining a net gas flow deviation as a function of a difference between the calculated net gas flow and the expected net gas flow;

and wherein the correcting step corrects the estimated pressure as a function of the net gas flow deviation.

11. The method of claim 10, further comprising the step of:

identifying when the current engine system operating condition is a steady state operating condition characterized by substantially no gas accumulation or depletion at the selected pneumatic node;

wherein the correcting step corrects the pressure estimate as a function of the net gas flow deviation when the current engine system operating condition is identified as a steady state operating condition, and wherein the expected net gas flow is approximately zero.

* * * * *